US007546688B2

(12) United States Patent
Watanabe et al.

(10) Patent No.: US 7,546,688 B2
(45) Date of Patent: Jun. 16, 2009

(54) PARALLEL RULER DEVICE

(75) Inventors: Shunsuke Watanabe, Shizuoka (JP); Masaru Yoshida, Shizuoka (JP)

(73) Assignee: Off Corporation Inc., Shizuoka-ken (JP)

( * ) Notice: Subject to any disclaimer, the term of this patent is extended or adjusted under 35 U.S.C. 154(b) by 0 days.

(21) Appl. No.: 12/003,470

(22) Filed: Dec. 26, 2007

(65) Prior Publication Data

US 2008/0148582 A1 Jun. 26, 2008

(30) Foreign Application Priority Data

Dec. 26, 2006 (JP) ..... 2006-349955

(51) Int. Cl.
*B43L 7/10* (2006.01)

(52) U.S. Cl. ..... 33/454; 33/403; 33/485; 33/626; 83/745

(58) Field of Classification Search ..... 33/454, 33/452, 464–466, 474, 483–485, 489, 626, 33/403; 83/455, 745; 30/383
See application file for complete search history.

(56) References Cited

U.S. PATENT DOCUMENTS 3,635,396 A * 1/1972 Palfi ..... 33/464
4,593,590 A * 6/1986 Gray ..... 83/438
5,138,759 A * 8/1992 Gruetzmacher ..... 83/745
5,152,069 A * 10/1992 Lee ..... 33/454
5,379,669 A * 1/1995 Roedig ..... 33/641
5,964,041 A * 10/1999 Daniel ..... 33/403
2005/0139056 A1* 6/2005 Gass et al. ..... 83/438
2007/0144319 A1* 6/2007 Jones ..... 83/745
2008/0236355 A1* 10/2008 Gass et al. ..... 83/438

FOREIGN PATENT DOCUMENTS

JP 11-239913 7/1999
JP 2006-297882 2/2006

* cited by examiner

*Primary Examiner*—Yaritza Guadalupe-McCall
(74) *Attorney, Agent, or Firm*—Jacobson Holman PLLC

(57) ABSTRACT

To provide a parallel ruler device with which it is easy to obtain a plate material of a constant width having parallel sides. Also, to make it possible to easily carry out a precision adjustment of an amount of parallel movement of a ruler face by means of a visual observation. Also, to enable a precision adjustment of a desired dimension in both a positive direction and a negative direction with a position fixed once as a base point. In a parallel ruler device which includes a moving body movable along a sliding portion provided on a main body, and in which the moving body has a sliding counterpart making contact with the sliding portion, and is configured in such a way that a ruler face set in a portion other than the sliding counterpart moves in parallel along with the movement of the moving body, an inclined sliding portion 12 is set in a direction intersecting a longitudinal direction of the main body 11, a direction of the ruler face 17 of the moving body is set in a direction intersecting that of the sliding counterpart 16 of the moving body 15 which slides along the inclined sliding portion, and the ruler face of the moving body is configured in such a way as to move away from or near to the main body along with the movement of the moving body.

7 Claims, 6 Drawing Sheets

PARALLEL RULER DEVICE

BACKGROUND OF THE INVENTION

1. Technical Field

The present invention relates to a parallel ruler device which includes a moving body movable along a sliding portion provided on a main body, and in which the main body has a sliding counterpart making contact with the sliding portion, and a ruler face set in a portion other than the sliding counterpart, and the ruler face moves in parallel along with the movement of the moving body.

2. Related Art

When cutting, for example, a wooden plate material, it is a common practice that a circular sawing machine is guided using a kind of ruler commonly called a fence or the like. At this time, as a way of positioning and fixing the ruler exerts an influence on an accuracy of the cutting, it is an important matter, particularly in order to obtain a plate material of a constant width having parallel sides. There are various kinds of tool contrived in order to aid this operation and, in a case of JP-A-11-239913, a ruler plate is attached to a lower surface of a substrate in such a way as to project toward one side of the substrate, a base plate of a circular saw, which is placed on the ruler plate, is caused to abut against an abutment surface of the substrate, and a standard use width is set with an outer edge of the ruler plate brought into close proximity with a side surface of a rotary blade. However, with this kind of structure, as the circular saw cannot be moved in parallel, it merely serves for only one cutting.

In response to this, JP-A-2006-297882 has a configuration in which a trigger is attached to a handle attached to a base, a movable scale is protruded by squeezing the trigger, and aligned on a marking-off line desired to be cut along, and subsequently, by stopping squeezing the trigger, the movable scale is returned to a position extending along the base, in which condition a portable electric saw is moved along the movable scale. However, with this configuration too, although the portable electric saw enables an accurate cutting along the marking-off line, as the movable scale is protruded due to a rotation of a link arm, it lacks strength or accuracy in the protruded condition, and is difficult to use as a guide. Also, as the movable scale cannot be fixed in an optional protruded position either, it is not very useful in obtaining the plate material of the constant width having the parallel sides.

SUMMARY OF THE INVENTION

The invention having being contrived focusing attention on the heretofore described points, an object thereof is to provide a parallel ruler device with which it is possible to easily cut and obtain a plate material of a constant width having parallel sides, or to easily draw parallel lines on a work. Also, another object of the invention is to be able to easily carry out a precision adjustment of an amount of parallel movement of a ruler face by means of a visual observation. Also, still another object of the invention is to enable a precision adjustment of a desired dimension in both a positive direction and a negative direction with a position fixed once as a base point.

In order to achieve the heretofore described objects, in the invention, as a parallel ruler device which includes a moving body which can move along a sliding portion provided on a main body, and in which the moving body has a sliding counterpart sliding on the sliding portion, and is configured in such a way that a ruler face set in a portion of the moving body other than the sliding counterpart moves in parallel along with the movement of the moving body, a measure is taken whereby an inclined sliding portion is set in a direction intersecting a longitudinal direction of the main body, a direction of the ruler face of the moving body is set in a direction intersecting that of the sliding counterpart of the moving body which slides along the inclined sliding portion, and the ruler face of the moving body is configured in such a way as to move away from or near to the main body along with the movement of the moving body.

It is desirable that the parallel ruler device including the main body has an aspect as narrow in width as possible, because of the nature of a ruler, and because a relatively large amount of adjustment can be made for an amount of parallel movement of the ruler face. A parallel ruler is heretofore known which has a configuration in which the ruler face moves in parallel along with the movement of the moving body. That is, with regard to the configuration of the parallel movement of the ruler face, the invention also includes elements common to those of the heretofore known example.

In the parallel ruler device according to the invention, the inclined sliding portion is set in the direction intersecting the longitudinal direction of the main body, and the direction of the ruler face of the moving body is set in the direction intersecting that of the sliding counterpart of the moving body which slides along the inclined sliding portion. The setting of the inclined sliding portion of the main body in the direction intersecting the longitudinal direction of the main body leads to a division of the movement of the moving body along the inclined sliding portion of the moving body into a component amount in a direction parallel to the longitudinal direction of the main body, and a component amount in a direction perpendicular thereto. As a result, a portion in the parallel direction moves away from or near to the main body. The portion in the parallel direction corresponds to the ruler face in the invention.

It is not that it cannot be said that the portion in the perpendicular direction also moves away from or near to the main body. Also, it can be said that not only the portions in the directions parallel to and perpendicular to the longitudinal direction of the main body, but also a portion in another direction moves away from or near to the main body. However, as the portion in the direction parallel to the longitudinal direction of the main body, from the nature of a ruler to which the invention belongs, is most useful in a cutting, a line drawing, a marking and the like, it can be considered that a setting of the ruler face in the portion in the direction parallel to the longitudinal direction of the main body is of particular significance. The above point is shown in an example 1 to be described hereafter.

As well as a plurality of the inclined sliding portions of the main body being disposed in parallel in two portions, front and back, or more extending along the longitudinal direction of the main body, a plurality of the sliding counterparts of the moving body which slide along the corresponding inclined sliding portions are provided in a number equal to or greater than the number of inclined sliding portions, and the moving body is supported in at least the two front and back portions, which configuration, stabilizing the support even in the event that a length of the inclined sliding portions and the sliding counterparts is shortened, is useful. For this reason, a purpose is satisfactorily accomplished by supporting the moving body in the two front and back portions, but without prejudice to a provision of a greater number of support portions according to need. A specific configuration after this point will be described in an example 2.

In the invention, it is possible to arrange in such a way that at least either the inclined sliding portion or the sliding counterpart is configured of an inclined surface set in a direction intersecting a moving direction of the moving body. This implies that neither the inclined sliding portion nor the sliding counter part has to be an inclined surface. This means that it is also acceptable that, for example, one of the inclined sliding portion or the sliding counterpart is configured as an inclined surface, and the other is made of an optional member disposed along the inclined surface. Also, in a case of there being an inclined surface, the inclined surface, not being limited to one such as a hypotenuse of a right triangle, includes a member having a structure which is configured of a slidable depressed groove or raised ridge disposed obliquely.

In the invention, as an aspect having a specific configuration of a parallel ruler device which includes a moving body movable along a sliding portion provided on a main body, and in which the moving body has a sliding counterpart contacting the sliding portion, and is configured in such a way that a ruler face set in a portion of the moving body other than the sliding counterpart moves in parallel along with the movement of the moving body, for example, it is possible to arrange in such a way that the main body, being formed to be long, has the moving body which is movable along the sliding portion provided on the main body, and is formed to be as long as the main body, the sliding portion is configured as an inclined sliding portion provided with a channel in a direction intersecting a moving direction of the moving body, and the moving body, having a sliding piece, which is made movable while fitting in the channel, as a sliding counterpart, is thereby configured in such a way that the ruler face of the moving body moves away from or near to the main body along with the movement of the moving body.

It is possible that an inclination of the inclined sliding portion or the sliding counterpart which is set in the direction intersecting the moving direction of the moving body has an inclined angle set in such a way that a distance B in a perpendicular direction away from the longitudinal direction of the main body is smaller than a distance A in the longitudinal direction of the main body, and the moving body is configured in such a way as to move away from or near to the main body at a rate proportional to a ratio B/A of the distances. This shows that, the greater the denominator A, the smaller the amount of parallel movement, consequently enabling the precision adjustment. For example, in the event that the distance A in the moving direction of the moving body is 10, and the distance B in the direction away from the main body is 1, it enables the precision adjustment of the amount of parallel movement of the ruler face with a ten times higher accuracy while, in the event that the distance B in the direction away from the main body is 2, it enables the precision adjustment with a five times higher accuracy.

Also, it is possible that a work fixing member which can move relatively in the longitudinal direction of the main body is provided on the main body. The work fixing member is provided in this way, and an indicator is combined, thereby enabling the precision adjustment in both the positive direction and the negative direction with a certain point as a base point, and also, making a position of the main body, which is likely to shift to one side due to the parallel movement, correctable to be within a range of the ruler face of the moving body, enabling an easier operation. Furthermore, it is possible to arrange in such a way as to include the work fixing member which fixes the work in order to aid in processing the work, including the cutting, the line drawing and the marking, with the ruler face of the moving body as a guide surface. Although a clamp can be provided as a fixing unit on the work fixing member, in the event that the provision is only for the purpose of fixing the work on the device, it is also acceptable that the clamp is provided directly on the main body.

It being possible to, as well as providing a scale, for ascertaining moving distances in the direction parallel to and perpendicular to the longitudinal direction of the main body, on one of the main body or the moving body, provide an indicator, which indicates a position on the scale, on the other, it is possible, from this configuration and the heretofore described ratio B/A of the distances on the inclined surface, to know how much the amount of parallel movement is. That is, as an amount of parallel movement in the event that the indicator moves 100 mm on the scale, and the ratio B/A is 1/10, the accuracy is ten times higher.

As the invention is configured and operates in the above way, it is possible to provide a parallel ruler device with which it is possible to easily process the work to obtain a plate member of a constant width having parallel sides, or easily draw parallel lines. Also, according to the invention, it is possible to easily carry out the precision adjustment of the amount of parallel movement of the ruler face by means of a visual observation. Furthermore, according to the invention, an advantage is achieved which enables a precision adjustment of a desired dimension in both the positive direction and the negative direction with a position fixed once as the base point.

DESCRIPTION OF THE PREFERRED EMBODIMENT(S)

Figure 1:
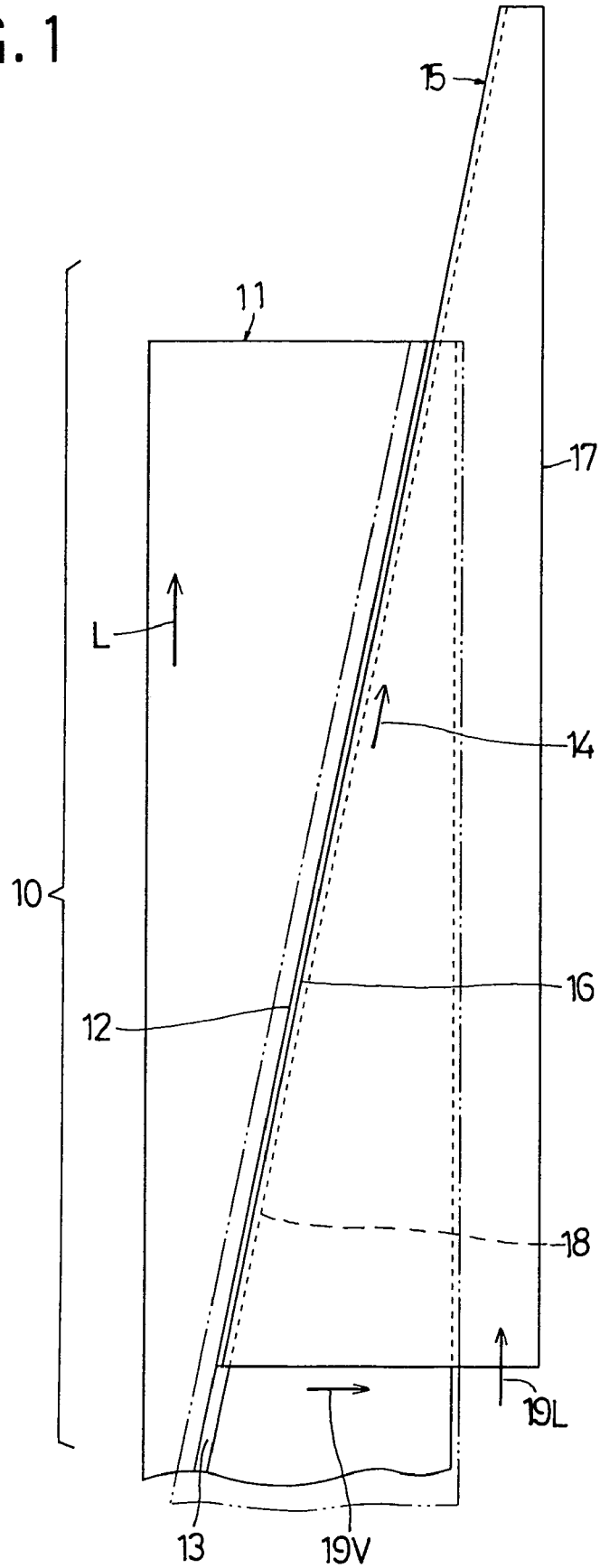
FIG. 1 is a plan view of a main portion, showing an example 1 of a parallel ruler device according to the invention.

Hereafter, a further detailed description will be given of the invention, while referring to embodiments shown in the drawings. FIG. 1 showing an example 1 having a minimum necessary configuration of a parallel ruler device 10 according to the invention, reference numeral 11 is a main body having an aspect narrow in width, which has an inclined sliding portion 12 set in a direction intersecting a longitudinal direction L of the main body 11. Reference numeral 15 is a moving body, which has a sliding counterpart 16 sliding along the inclined sliding portion 12, and has a ruler face 17 set parallel to the longitudinal direction L in a portion other than the sliding counterpart. A direction of the ruler face 17 is set in a direction intersecting that of the moving body's sliding counterpart sliding along the inclined sliding portion 12.

As the inclined sliding portion 12 is inclined at a ratio of a distance A in the longitudinal direction and a distance B in a perpendicular direction away from the longitudinal direction, that is, at a gradient B/A=1/5, and has an inclined surface set in a direction intersecting a moving direction of the moving body 15, it is possible to obtain a five times higher accuracy in comparison with one inclined at 1/1. The inclined sliding portion 12 shown in the figure has an aspect of a depressed groove 13 and, the sliding counterpart 16, configured of a raised ridge 18, which has an inclined surface, fitting in the depressed groove 13, the inclined sliding portion 12 and the sliding counterpart 16 slides on each other. Consequently, the example 1 is one in which each of the inclined sliding portion 12 and the sliding counterpart 16 is configured of the inclined surface set in the direction intersecting the moving direction of the moving body 15.

In the device of the example 1, the moving body 15, upon being slid in a direction of an arrow 14 along the inclined sliding portion 12 of the main body 11, moves in the perpendicular direction by an amount equivalent to a component amount (an arrow 19L) in a direction parallel to the longitudinal direction of the main body, and to a component amount (an arrow 19V) in the perpendicular direction. In the example 1 shown in the figure, as the ratio B/A of the distances in the longitudinal direction and the perpendicular direction is 1/5, the ruler face 17 of the moving body 15 moves away from or near to the main body 11 in the perpendicular direction by 1/5 of the component amount in the longitudinal direction of the main body, that is, in the direction parallel thereto. Therefore, it is possible to implement an operation, such as a drawing of parallel lines or a marking, with the five times higher accuracy. The device 10 of the example 1, by pressing the moving body 15 against the main body 11, or fixing it by means of a heretofore known clamp or the like, is also applicable to a cutting operation.

Figure 2:
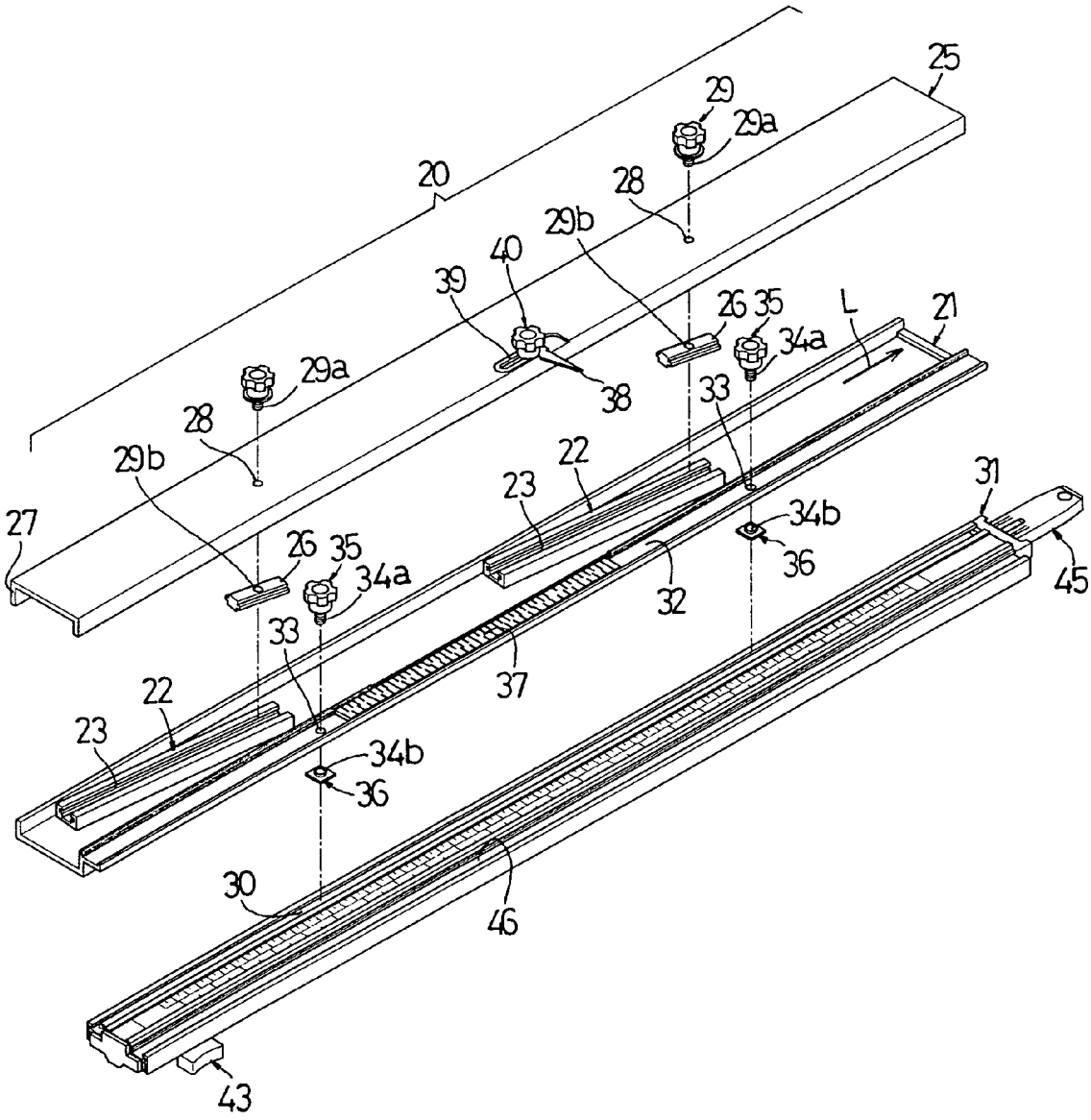
FIG. 2 is a disassembled perspective view showing an example 2 of the parallel ruler device according to the invention in the same way.
Figure 3:
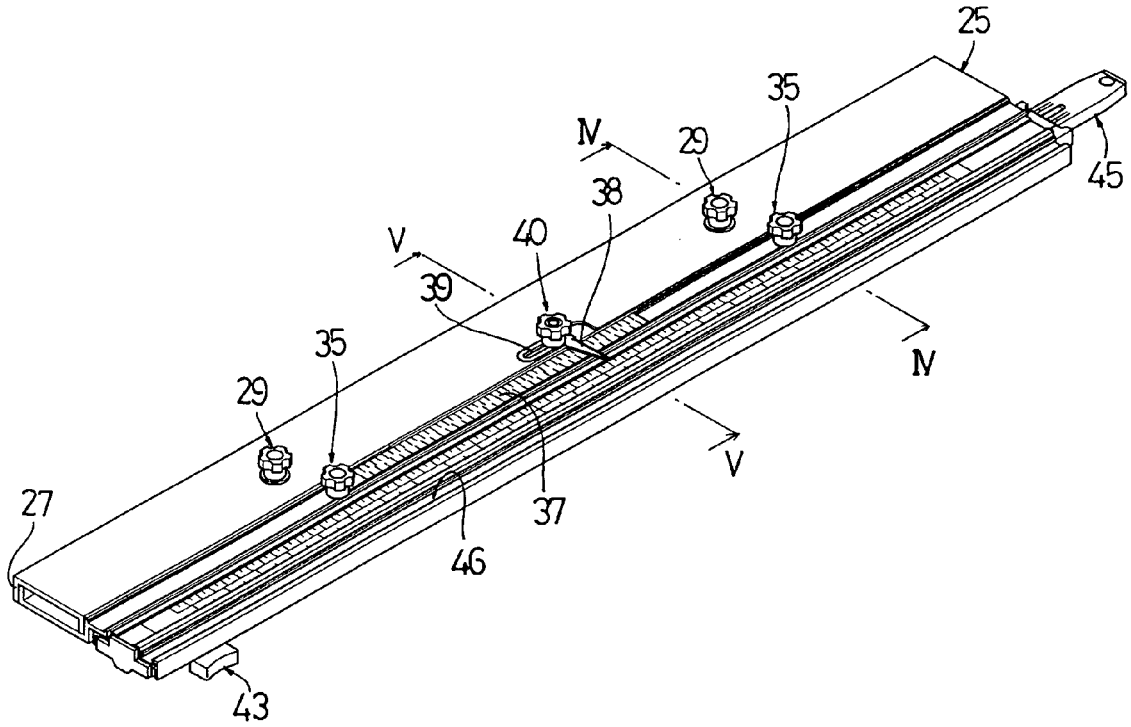
FIG. 3 is a perspective view of the same device of the example 2 as above.
Figure 4:
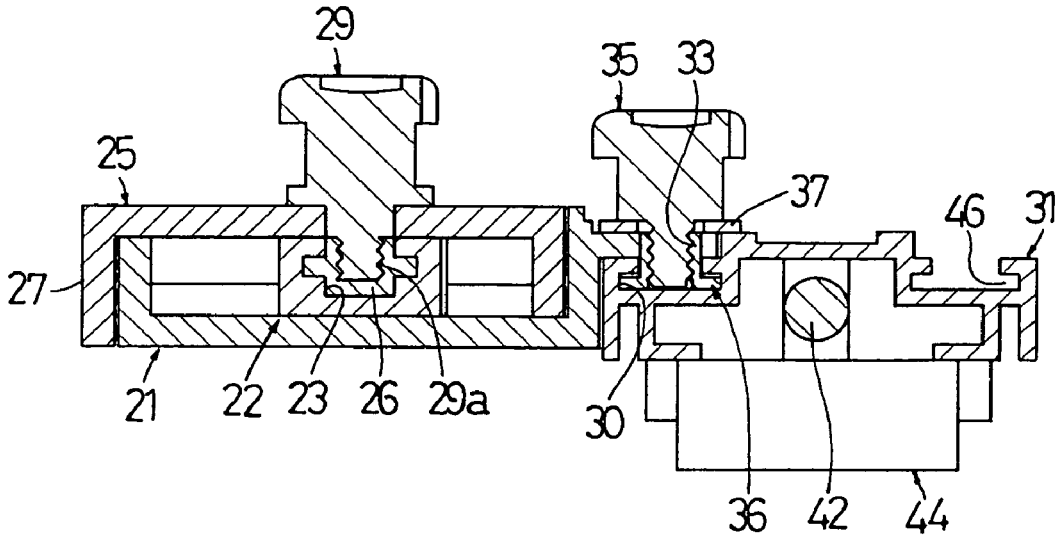
FIG. 4 is a sectional view taken along line IV-IV of FIG. 3.
Figure 5:
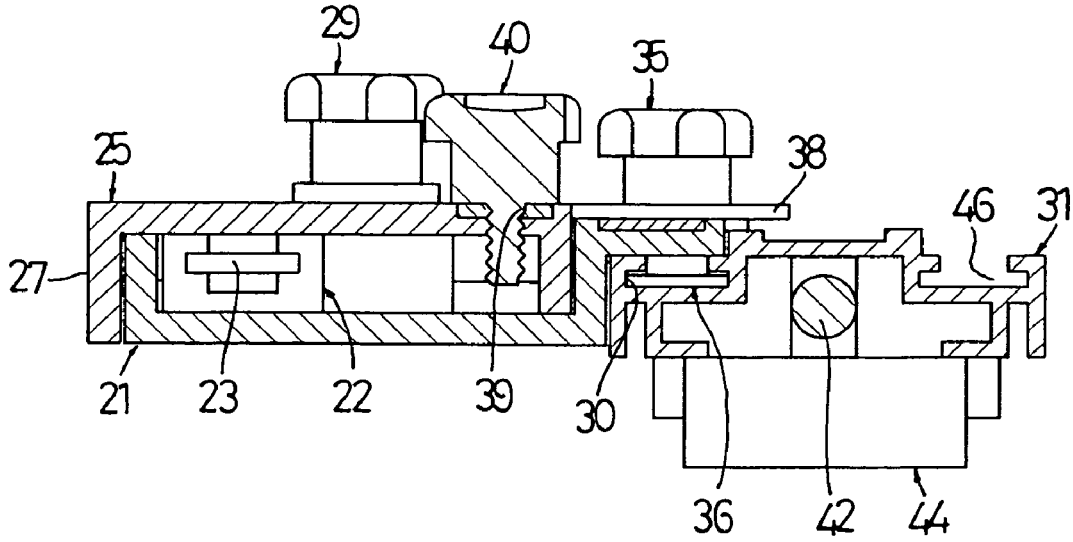
FIG. 5 is a sectional view taken along line V-V of FIG. 3.
Figure 6:
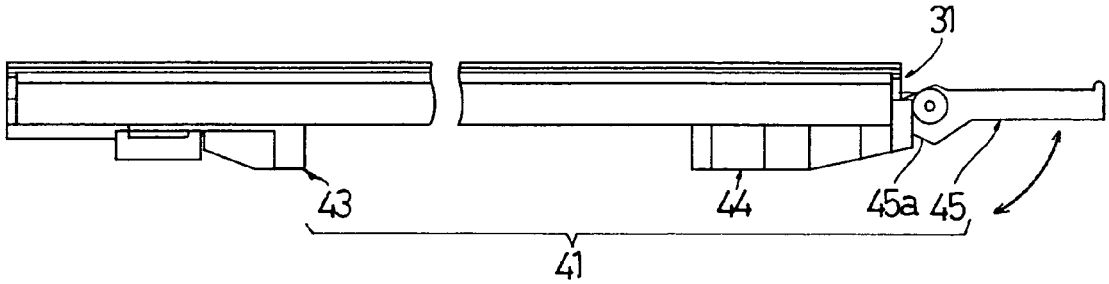
FIG. 6 is a front view of the same device of the example 2 as above.
Figure 7:
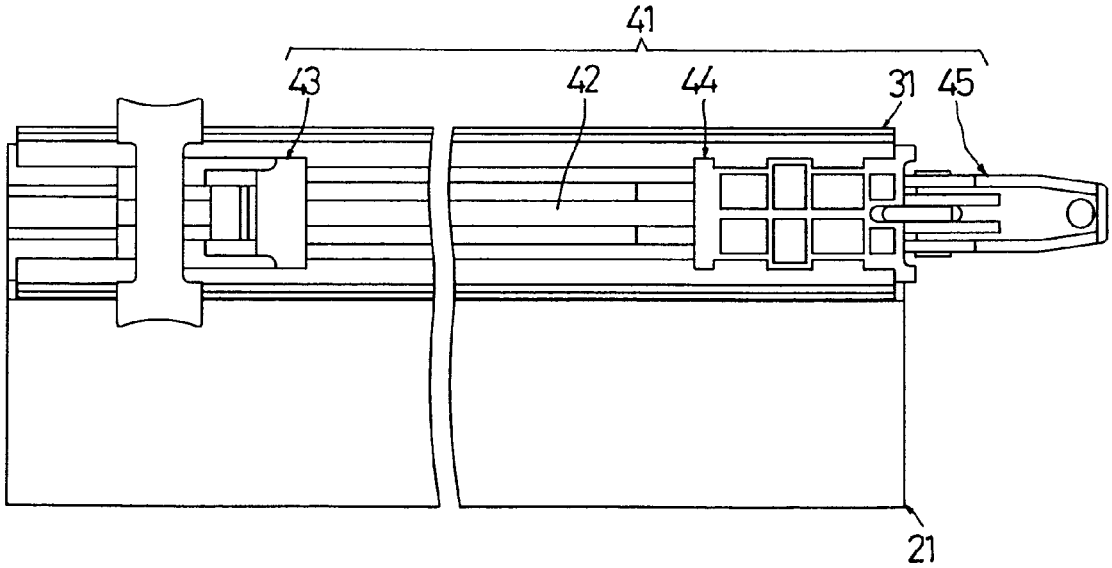
FIG. 7 is a bottom view of the same device of the example 2 as above.

FIG. 2 shows an example 2 having an ideal configuration as a parallel ruler device 20 according to the invention, which has an aspect narrow in width, in the same way as in the example 1, and has a main body 21 formed to be long, inclined sliding portions 22 which are set in a direction intersecting a longitudinal direction L of the main body 21, a moving body 25, and sliding counterparts 26 sliding along the inclined sliding portions 22. The inclined sliding portions 22 of the example 2 are inclined at a gradient of B/A=1/10 as the ratio of the distances in the longitudinal direction and the perpendicular direction, consequently enabling a precision adjustment with a ten times higher accuracy.

The inclined sliding portions 22 of the example 2, being configured of molded materials having channels 23 in a direction intersecting a moving direction of the moving body, are disposed in parallel in two portions of the main body 21 in the longitudinal direction L. Each of the channels 23 of the example 2 is configured of a depressed groove having an approximate C-shape in a cross-section, and each of the sliding counterparts 26 has an aspect of a sliding piece which is made movable while fitting in the channel 23 in such a way as not to drop out therefrom. The sliding pieces are each fastened or loosened with stators 29 inserted through small holes 28 opened in an upper surface of the moving body 25. Reference numeral 29*a* depicts an external thread of each sliding piece, and 29*b* an internal thread. Consequently, the sliding counterparts 26 double as a unit which connects the main body 21 and the moving body 25.

A ruler face 27 is provided on an outer side edge portion of the moving body 25 which extends in the longitudinal direction L. A direction of the ruler face 27 is a direction intersecting that of the inclined sliding portions 22 too, ultimately, a direction parallel to the longitudinal direction of the main body 21. In the device of the example 2, a work fixing member 31, which can move relatively in the longitudinal direction of the main body 21, and is formed to be as long as the main body 21, is attached to the other side edge portion of the main body 21 which extends in the longitudinal direction. As units provided in such a way that the work fixing member 31 can move relatively in the longitudinal direction of the main body 21, small holes 33 through which stators 35 are inserted are provided in a side edge 32 extending along the other edge portion of the main body 21, and sliders 36 having internal threads 34*b*, onto which external threads 34*a* of the stators 35 are screwed, are slidably fitted in an inner slide groove 30 of the work fixing member 31.

Furthermore, in order to enable the precision adjustment in both a positive direction and a negative direction with a certain point as a base point, a scale 37 for use in a parallel moving distance measurement is provided in the longitudinal direction of the main body 21, and the moving body 25 is provided with an indicator 38 indicating a position on the scale. In order to attach the indicator 38 in such a way that it is movable, an elongated hole 39 is formed in the moving body 25 in a direction of the scale, and the indicator 38 is fixed by means of a setscrew 40 screwed into a threaded hole in the moving body 25 from the elongated hole 39, in such a way as to enable a fine adjustment of the position within a range of the elongated hole 39.

Also, in order to process a work W, including a cutting, a line drawing and a marking, with the ruler face 27 of the moving body 25 as a guide surface, a clamp 41 is combined as a fixing unit. The clamp 41 is configured of a shaft member 42 passed through a portion of a lower surface of the work fixing member 31 which extends in the longitudinal direction of the main body, a movable member 43 provided in such a way as to be movable and stoppable along the shaft member 42, a fixed member 44 attached to an end of the shaft member, and a cam lever 45 having a cam 45*a* which is pressed into the fixed member 44 in a direction of a movable clamping. The clamp 41 sandwiches the work W by means of the movable member 43 and the fixed member 44, and finally, fixes the work W by means of an operation of fastening the work W by operating the cam lever 45, and it is possible to remove the work W from the movable member 43 and the fixed member 44 in a reverse way as the operation described above.

In the parallel ruler device 20 of the example 2 configured in this way, by loosening the stators 29 and 35, the main body 21 is placed into a condition in which it is movable with respect to each of the moving body 25 and the work fixing member 31, while it is possible, by fastening the stators 29 and 35, to fix the main body 21 to each of the moving body 25 and the work fixing member 31. In a condition in which the moving body 25 is in close contact with the main body 21, the sliding counterparts 26 are at farthest ends of the inclined sliding portions 22 (in FIG. 2, right ends thereof), at which time an adjustment is made in such a way that the indicator 38 is positioned at zero on the scale 37, and the stators 29 and 35 are fastened. Alternatively, a position indicated by the indicator 38 is stored or recorded.

The work W is fastened with the clamp 41 and fixed, a mark is made in a necessary position, the stators 29 are loosened after that, the moving body 25 is moved a necessary distance in the longitudinal direction, and a mark is made therein again, whereby two parallel marks are drawn on the work. In the event that, in place of the heretofore described marking, the cutting operation is carried out using a circular sawing machine or the like, it is possible to cut out a plate material into a width defined by the two marks. During these operations, for sake of safety too, a predetermined operation is carried out with the stators 29 and 35 fastened in a fixing position, and the stators 29 and 35 are loosened only when necessary. When a circular saw or the like is installed in the device according to the invention, it is possible to use the ruler face as a guide.

Figure 8:
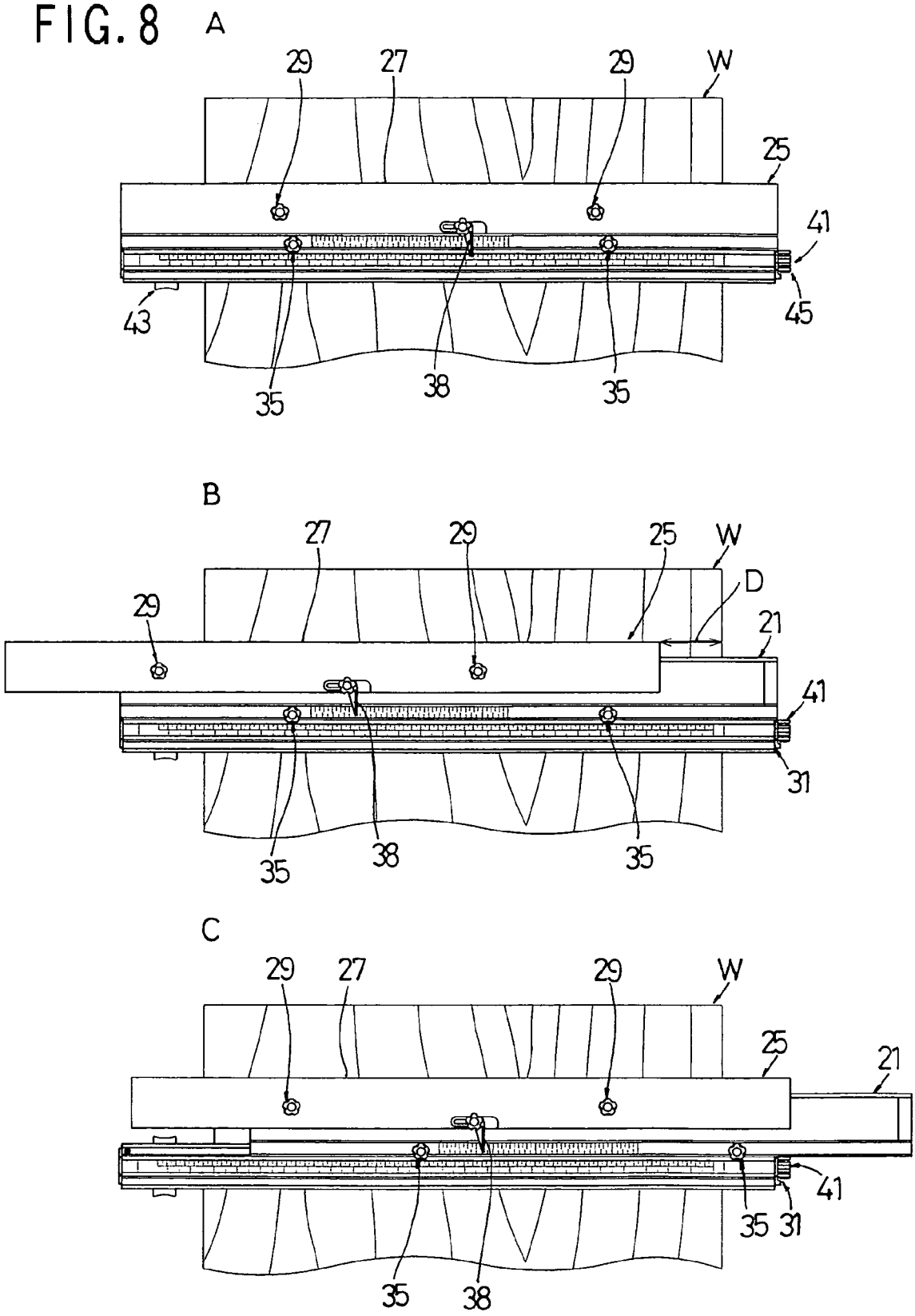
FIGS. 8A, 8B and 8C, showing one example of a method of using the device of the example 2, are illustrations of when a work is attached, when a moving body is moved a necessary distance, and when a main body is moved parallel to a work fixing member, respectively.

In a method of using the device according to the invention, when marking the work, there is a case in which, as the work is large, it deviates from a range of the ruler face 27, but it is possible to response to this kind of case in a following way. In a case of using the device of the example 2, first, in a condition in which the stators 29 and 35 are fastened, the work W is attached to the parallel ruler device 20 by operating the clamp 41 (FIG. 8A). Herein, a position indicated by the indicator 38 is ascertained, the indicated position is recorded according to need, and a mark is made on the work W along the ruler face 27. Subsequently, the stators 29 are loosened, as well as the moving body being moved a necessary distance with respect to the main body 21 (FIG. 8B), it is ascertained, based on the position indicated by the indicator 38, that the moving body has been moved the necessary distance, and the stators 29 are fastened. However, in FIG. 8B, as a right end D of the work W deviates from the range of the ruler face 27, the stators 35 are loosened and, by moving the main body 21 parallel to the work fixing member 31 with a positional relationship maintained between the main body 21 and the moving body 25 (FIG. 8C), it is possible to make marks on a whole width of the work W within the range of the ruler face 27.

The invention claimed is:

1. A parallel ruler device comprising a moving body which is movable along a sliding portion provided on a main body, the moving body having a sliding counterpart sliding on the sliding portion, and being configured in such a way that a ruler face set in a portion of the moving body other than the sliding counterpart moves in parallel along with the movement of the moving body, wherein an inclined sliding portion is set in a direction intersecting a longitudinal direction of the main body, a direction of the ruler face of the moving body is set in a direction intersecting that of the sliding counterpart of the moving body which slides along the inclined sliding portion, and the ruler face of the moving body is configured in such a way as to move away from or near to the main body along with the movement of the moving body.

2. The parallel ruler device according to claim 1, wherein, as well as a plurality of the inclined sliding portions of the main body being disposed in parallel in two portions, front and back, or more extending in the longitudinal direction of the main body, a plurality of the sliding counterparts of the moving body which make contact with the corresponding inclined sliding portions are provided in a number equal to or greater than the number of inclined sliding portions, and the moving body is supported in at least the two front and back portions.

3. The parallel ruler device according to claim 1, wherein at least either the inclined sliding portion or the sliding counterpart is configured of an inclined surface set in a direction intersecting a moving direction of the moving body.

4. The parallel ruler device according to claim 1, wherein an inclination of the inclined sliding portion or the sliding counterpart which is set in the direction intersecting the moving direction of the moving body has an inclined angle set in such a way that a distance B in a perpendicular direction away from the longitudinal direction of the main body is smaller than a distance A in the longitudinal direction of the main body, and the moving body is configured in such a way as to move away from or near to the main body at a rate proportional to a ratio B/A of the distances.

5. A parallel ruler device comprising a moving body which is movable along a sliding portion provided on a main body, the moving body having a sliding counterpart sliding on the sliding portion, and being configured in such a way that a ruler face set in a portion of the moving body other than the sliding counterpart moves in parallel along with the movement of the moving body, wherein the main body, being formed to be long, has the moving body which is movable along the sliding portion provided on the main body, and is formed to be as long as the main body, the sliding portion is configured as an inclined sliding portion provided with a channel in a direction intersecting a moving direction of the moving body, and the moving body, having a sliding piece, which is made movable while fitting in the channel, as a sliding counterpart, is thereby configured in such a way that the ruler face of the moving body moves away from or near to the main body along with the movement of the moving body.

6. The parallel ruler device according to claim 5, having a configuration in which a work fixing member which can move relatively in the longitudinal direction of the main body is provided on the main body, and a clamp which fastens either side of a work is provided on a lower surface of the work fixing member.

7. The parallel ruler device according to claim 5, wherein a scale for ascertaining moving distances in a parallel direction and the perpendicular direction is provided, parallel to the moving direction of the moving body, on one of the main body or the moving body, and an indicator which indicates a position on the scale is provided on the other.

* * * * *